United States Patent [19]

Suica et al.

[11] Patent Number: 5,072,834

[45] Date of Patent: Dec. 17, 1991

[54] SCREENING APPARATUS FOR PAPER MAKING STOCK

[75] Inventors: David E. Suica, Cincinnati; Michael F. Kinne, Trenton; Gary S. Williamson, Middletown, all of Ohio

[73] Assignee: The Black Clawson Company, Middletown, Ohio

[21] Appl. No.: 615,209

[22] Filed: Nov. 19, 1990

[51] Int. Cl.[5] ..... B07B 1/20

[52] U.S. Cl. ..... 209/273

[58] Field of Search ..... 209/268, 270, 273; 162/55

[56] References Cited

U.S. PATENT DOCUMENTS

| | | | |
|---|---|---|---|
| 3,713,536 | 1/1973 | Hooper | 209/273 |
| 3,964,996 | 6/1976 | Holz et al. | 209/273 X |
| 4,043,919 | 8/1977 | Hutzler | 209/273 X |
| 4,111,373 | 9/1978 | Holz | 209/273 X |
| 4,447,320 | 5/1984 | Lamort | 209/273 |
| 4,855,038 | 8/1988 | LeBlanc | 209/273 |
| 4,981,583 | 1/1991 | Le Blanc | 209/273 |

*Primary Examiner*—Michael S. Huppert
*Assistant Examiner*—Edward M. Wacyra
*Attorney, Agent, or Firm*—Biebel & French

[57] ABSTRACT

Pressure screening apparatus for paper making stock embodies a cylindrical perforated screening member which defines screening and accepts chambers on the inside and outside thereof respectively in a closed housing which is filled with liquid stock under pressure in operation. A rotor member which operates in the screening chamber to keep the screening perforations open is specially constructed to provide it with sufficient buoyancy to counterbalance its weight when the apparatus is in operation and the housing is therefore filled with liquid stock. In the preferred form, the housing is mounted with the rotor axis horizontal, but it can also be made with the rotor axis vertical.

7 Claims, 4 Drawing Sheets

SCREENING APPARATUS FOR PAPER MAKING STOCK

BACKGROUND OF THE INVENTION

Paper mills have for many years made extensive use, for the cleaning of paper making stock, of pressure screening apparatus embodying a cylindrical perforated screening member which defines screening and accepts chambers on the opposite sides thereof in a closed housing, and wherein a rotor member operates in one of the chambers to keep the screening perforations open and free from solid material having a tendency to cling to the surface of the screening cylinder.

The assignee of this invention has manufactured and sold many such screens in accordance with a series of U.S. patents, commencing with Staege U.S. Pat. No. 2,347,716, and followed by Martindale U.S. Pat. No. 2,835,173 and numerous other patents including Seifert U.S. Pat. Nos. 3,849,302 and 4,105,543. In operation, the stock or furnish is delivered to the screening chamber adjacent one end of the screening cylinder, and the material rejected by the screening cylinder is collected and discharged from the opposite end of the screening chamber. In some cases, heavy reject material is prevented from entering the screening chamber so that only light reject material is removed after passing through the screening chamber, as shown in Martin-Sauzedde U.S. Pat. No. 4,851,111.

Starting with the construction shown in the above Martindale patent, all such screens manufactured and sold by applicants' assignee have been characterized by a rotor which included bars or vanes of airfoil section moving in closely spaced but non-contacting relation with the surface of the screening cylinder for the purpose of creating alternating positive and negative pressure waves or pulses effective on the perforations in the screening cylinder to prevent plugging thereof. Applicants' assignee has experimented to a considerable extent with detailed variations in screens of the above type, including variations in the vane shape and other forms of rotor, some such variations being shown in Seifert-Chupka U.S. Pat. No. 3,970,548, Chupka-Seifert U.S. Pat. No. 4,328,096 and Chupka et al U.S. Pat. No. 4,663,030.

SUMMARY OF THE INVENTION

The present invention has as its primary objective the provision of apparatus of the above general character for screening paper making stock wherein the rotor assembly is specially constructed to provide it with sufficient buoyancy to counterbalance its weight when the apparatus is in operation and the housing is therefore filled with liquid stock. This rotor construction is advantageous in screening apparatus of otherwise conventional construction wherein the housing is upright so that the axis of the rotor is vertical, but it is especially advantageous with such screening apparatus wherein the housing and the rotor axis are horizontal.

This is a particular advantage of the invention, in that it is considerably more practical and desirable to construct large screening apparatus of this general type with the axis thereof horizontal because this facilitates access to the interior of the housing for replacement of the screening cylinder or other maintenance. For example, a screening cylinder 7 or 8 ft. in length and in diameter may weigh as much as 2000 pounds and also requires head room in excess of its length above the apparatus when it is to be removed and replaced. When the apparatus is horizontal, access to the interior thereof and the replacement of the screening cylinder are correspondingly facilitated.

Other objects and advantages of the invention will be apparent from or pointed out in connection with the description of the preferred embodiments of the invention which follows.

DESCRIPTION OF THE PREFERRED EMBODIMENTS

Figure 1:
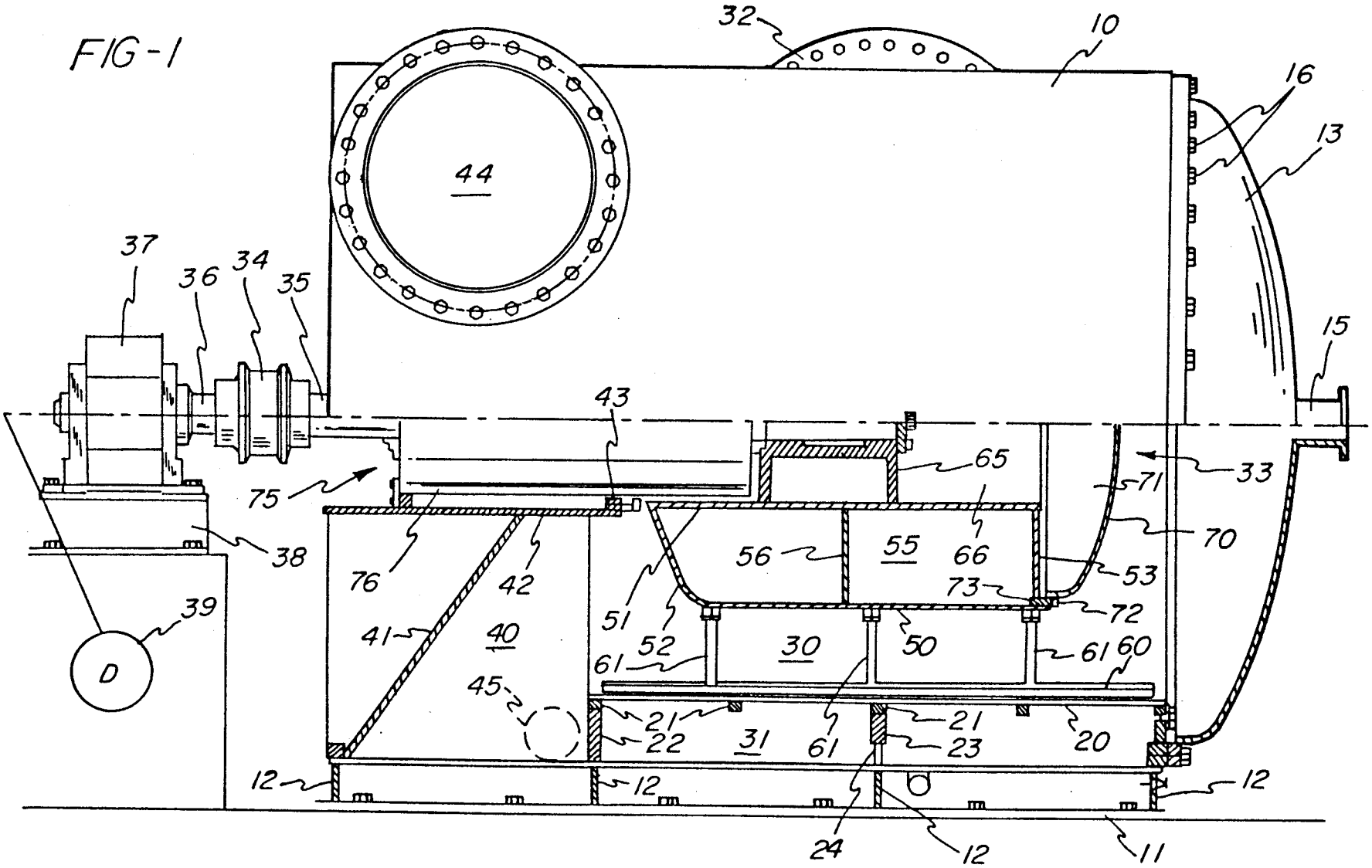
FIG. 1 is a view partly in side elevation and partly broken away illustrating the screening apparatus in accordance with the invention.
Figure 2:
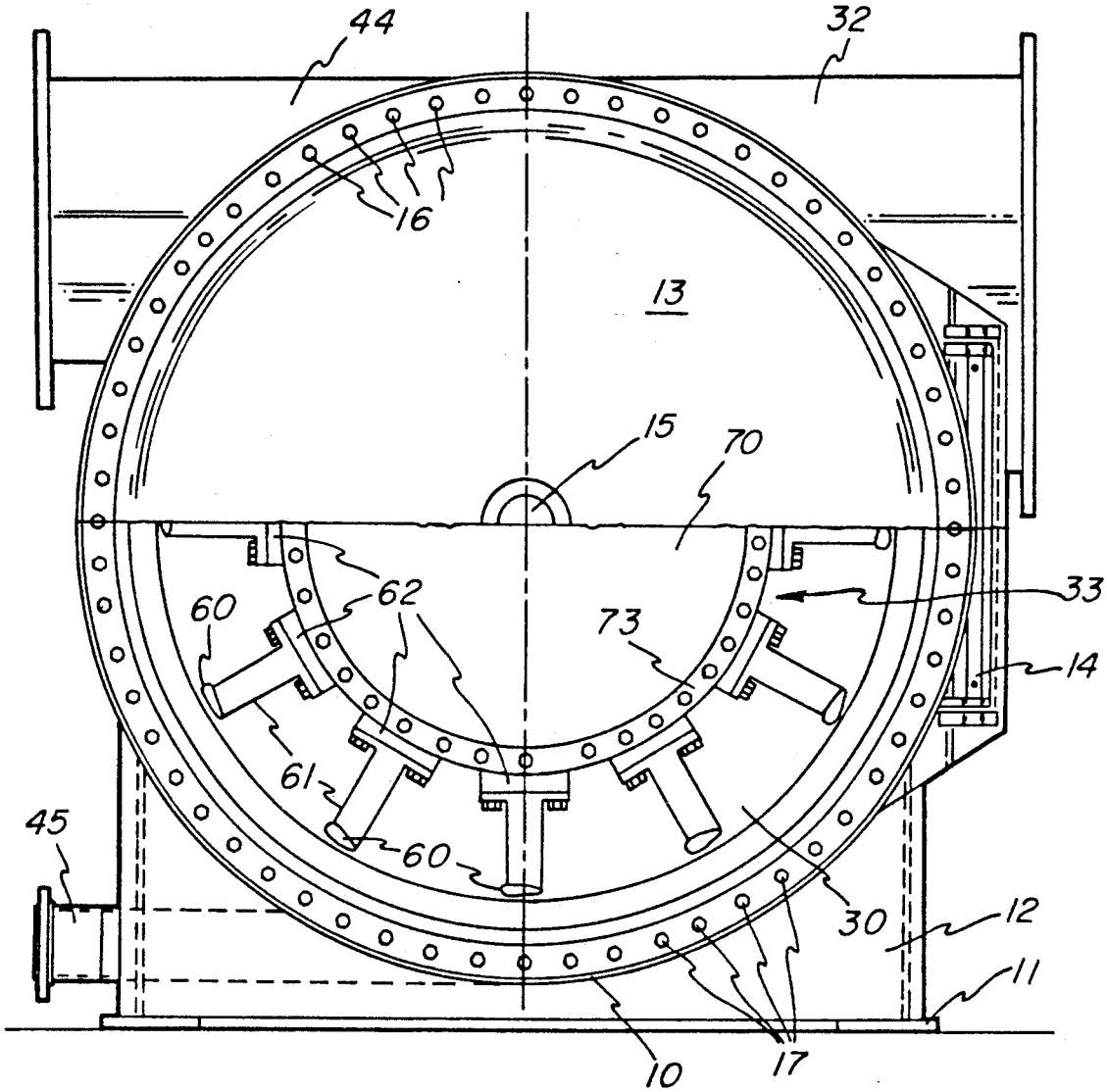
FIG. 2 is a view partly in elevation and partly broken away looking from right to left in FIG. 1.
Figure 3:
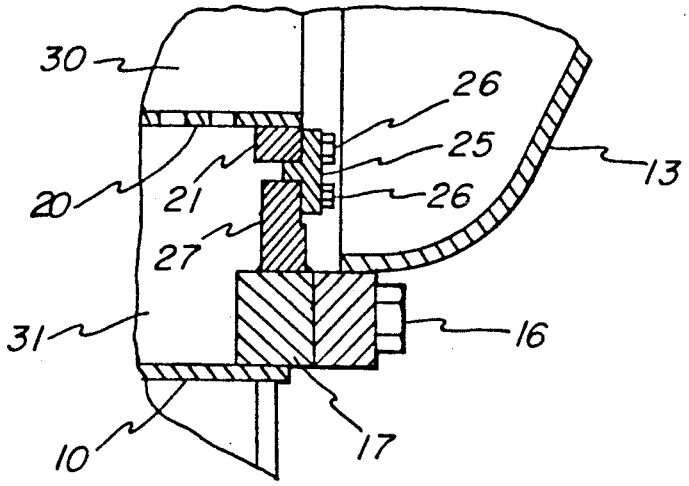
FIG. 3 is a fragment of FIG. 1 on a larger scale.

The primary structural component of the screening apparatus shown in FIGS. 1-3 is a cylindrical housing 10 which is mounted with its axis horizontal on a base 11 by brackets 12 or other suitable mounting means. A door 13 of domed configuration is provided with a hinged mounting 14 at the front end of the housing 10, and it also includes a centrally located outlet portion 15 for light reject material, as further described hereinafter. In its closed position, the door 13 is secured by bolts 16 to a flange 17 welded to the end of housing 10.

A screening cylinder 20 within housing 10 is provided with perforations of any desired size and shape, e.g. round holes or slots. The cylinder 20 includes external reinforcing rings 21 by which it is supported at its inner end on an annular flange 22 welded to the inner surface of the housing 10, and at its middle on a ring 23 having a radially slotted outer peripheral portion 24 welded to the housing 10. At the front end of the housing, the cylinder 20 is secured in position by a centering ring 25 secured by bolts 26 to the end ring 21 on cylinder 20 and a supplemental annular flange 27 welded to the end flange 17 on housing 10.

The cylinder 20 separates the interior of the housing 10 into a screening chamber 30 inside the cylinder and an annular accepts chamber 31 between the cylinder and the housing which is provided with an outlet port 32, and the slotted portion 24 of ring 23 provides for free flow of liquid throughout the accepts chamber 31. The rotor assembly 33 which operates within screening cylinder 20 is described in detail hereinafter. It is mounted on the front end of a drive shaft 35 which extends through the open end of the housing 10 from a coupling 34 connecting it with another shaft 36 supported in a bearing housing 37 having a fixed mounting 38. The shaft 36 is in turn connected to any suitable drive 39 as indicated diagrammatically in FIG. 1.

The inlet chamber 40 for stock to be screened is at the back or open end of the housing 10, and it is defined in part by a frustoconical wall 41 having its base welded to the back end of the housing 10 and its smaller end welded to a tubular member 42 having a reinforcing flange 43 at each end thereof. A tangential inlet port 44 delivers stock to be screened to the inlet chamber 40, and a tangential outlet port 45 leads from the bottom of the chamber 40 to a suitable receptacle for whatever heavy reject material may be entrained with the feed stock.

The rotor assembly 33 which is received within the screening cylinder 20 includes a rotor body composed of an outer tubular wall 50, an inner tubular wall 51 of substantially smaller diameter than wall 50, an annular rear end wall 52, which is shown as an inwardly formed end portion of the outer wall 50, and an annular front end wall 53, all of these walls being welded together to enclose an annular sealed compartment 55. Within this compartment there may also be a partition wall 56 welded between the inner and outer walls 50 and 51 for increased stiffness.

The rotor assembly 33 also includes a plurality of vanes 60 of airfoil shape in cross section, which are individually mounted on the outer surface of the tubular wall 50 by T-shaped brackets 61 welded to the associated vane 60 and bolted to boss members 62 welded at spaced locations on the outside of tubular member 50. The vanes 60 may be helically shaped as disclosed in the above Martindale patent, but satisfactory results are obtained if they are straight, and it is also desirable to utilize multiple vanes to minimize pulsing in the accepts chamber 31. Adjustment of the spacing between each vane and the inner surface of the screening cylinder 20 is readily effected by means of shims between each bracket 61 and its complementary boss 62.

An annular hub 65 is positioned relatively centrally of the inner tubular wall 51 and is welded thereto to seal the inner end of the cylindrical space 66 which extends from hub 65 to the front end of the tubular wall 51. The hub 65 is internally bored with a taper to fit tightly on the complementarily tapered outer end of the drive shaft 35. The hub 65 is secured on the drive shaft by a plate 67 secured by bolts 68 to the end of the drive shaft 35 and the hub 65.

The front end of the rotor assembly 33 is provided with a domed cover 70 which encloses the correspondingly dome-shaped space 71 connecting with the open space 66 in the outer end portion of the tubular wall 51 to form a second sealed compartment. The rim of the cover 70 is tightly secured to the remainder of the rotor assembly by bolts 72 threaded into the flange 73 on the end of the outer tubular wall 50, but which can be released to provide access to the hub 65 when the rotor assembly requires replacement.

Figure 4:
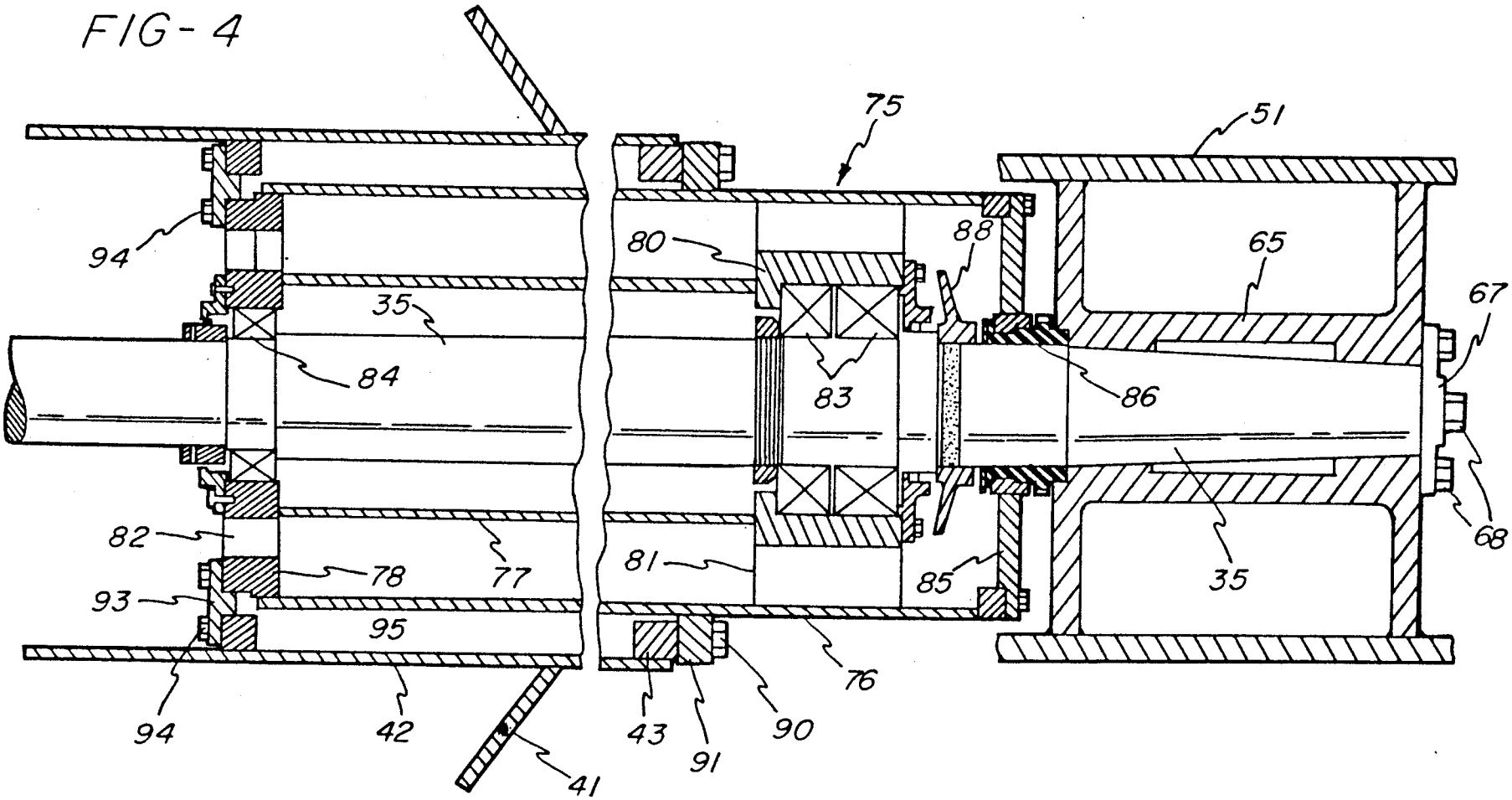
FIG. 4 is a view in axial section through the drive cartridge for the rotor of the screening apparatus shown in FIGS. 1 and 2.

The drive shaft 35 is mounted in the open end of housing 10 by a drive cartridge 75 best illustrated in FIG. 4. The cartridge 75 include concentric outer and inner tubes 76 and 77 which are connected at their rearward ends by a ring 78, and at their forward ends by an annular bearing cap 80 having exterior spoke portions 81 to provide for drainage therebetween. Similarly, the back end ring 78 is provided with drainage holes 82.

The bearing cap 80 encloses bearings 83 which support the front end of the drive shaft 35, and the back end ring 78 similarly encloses supporting bearings 84 for the shaft 62. An annular plate 85 secured on the forward end of the outer tube 76 forms a sealed connection with a conventional seal assembly 86 secured on shaft 35. A slinger ring 88 is mounted on the shaft 35 just forward of the bearing cap 80 to throw to the outside any liquid which may leak past the seals 86, and such liquid can then drain between the spokes 81 on bearing cap 80 and the holes 82 in the end ring 78. This entire cartridge is removably mounted in the tube 42 by bolts 90 which secure a peripheral flange 91 on tube 76 to a flange 92 on the forward end of the tube 42, and by a ring 93 secured by bolts 94 to the end ring 78 and a flange 95 on the tubular wall 42.

It is critical to accomplishing the purposes of the invention that the rotor body be so proportioned that the annular compartment 55 and the second compartment 65/71, both of which are filled with air, provide the rotor assembly as a whole with buoyancy which will substantially counterbalance its weight when the housing 10 is filled with liquid stock. In other words, it is the purpose of the invention that when the apparatus is in operation, the rotor assembly as a whole is effectively weightless so that the drive cartridge 75 is relieved from having to support the weight of the rotor assembly which otherwise would be cantilevered therefrom.

It will of course be apparent that in order to meet these objectives, special calculations must be made for each size of rotor assembly, and it is therefore possible in this description to provide only a set of dimensions which has proved to be practical for a specific size of screening apparatus, namely one wherein the screen cylinder 20 is 90 inches in axial length and also in diameter. Satisfactory approximate dimensions for the rotor assembly 33 for such a screen include an outer diameter of 60 inches for the outer tubular wall 50, an axial length of 60 inches for the inner tubular wall 51, and a diameter for the tubular wall 51 of approximately 32 inches. The hub 65 should be positioned to provide the open space 66 within wall 51 with an axial length of 22 inches, and the cone 70 should be proportioned to provide the space 71 with maximum axial dimension of 22 inches.

In operation, the feed stock enters the inlet chamber 40 tangentially through the inlet port 44 and swirls around that chamber before moving into the screening chamber 30. The combination of centifugal force and gravity will therefore cause any heavy reject particles which may still be in the stock to collect along the wall of that portion of housing 10 which forms the outside of the inlet chamber, and then to exit through the reject outlet 45. The rotor assembly 33 will be driven to rotate in the same direction as the entering stock, i.e. clockwise as viewed in FIG. 2, and in the zone adjacent the inside surface of the screening cylinder, the vanes 60 will operate in the desired manner to create alternating positive and negative pulsations adjacent the inner ends of the perforations in the cylinder 30 to minimize the possibility of blocking of any of the perforations by the suspended fibers in the stock.

Screening apparatus of the type of the present invention will most often be used just ahead of a paper making machine, and it is anticipated that during the preliminary preparation of that stock, at least the majority of heavy reject constituents will be eliminated. However, it is to be expected that the feed stock will still contain contaminant particles lighter than the paper making fibers, such particularly as bits of plastic film and foam too large to pass through the screening cylinder. The centrifuging action within the cylinder will cause this light reject material to be concentrated along the axis of the rotor assembly 33 in the space between the rotor cover 70 and the housing door 13, and it can be continuously bled off by maintaining a small flow of the resulting reject-rich suspension through the outlet 15 in the door.

It is essential to proper operation of all screening apparatus of this general type that the housing be maintained filled with liquid stock at all times during operation of the apparatus. Therefore, the rotor assembly 33 will at all times be submerged in liquid, so that the buoyancy provided by the sealed air space comprising the annular chamber 55 and the additional chamber 66/71 can effectively counterbalance the weight of the motor assembly which would otherwise apply a downward bending moment to the drive shaft 35. The rotor assembly is thereby enabled to operate in accurately centered relation within the screening cylinder 20 and therefore to produce uniform action by all of the vanes 60 on its outer surface.

Servicing of the screening apparatus according to the invention as shown in FIGS. 1–4 is greatly facilitated by the horizontal arrangement of the housing 10, to which access is readily provided by releasing the bolts 16 which hold the door 13 closed and opening this door. For example, the screening cylinders in pressure screens commonly require replacement fairly often, and this operation is facilitated in screens according to the present invention by the structure and mounting of the rotor assembly 33, in that the cylinder 20 is more easily replaced if the rotor assembly is temporarily removed.

More specifically, after the door 13 is opened, it is then necessary only to release the bolts 72 holding the domed cover 70 in position, and when this cover is removed, access is immediately available to the bolts 67 which hold the rotor hub 65 on the drive shaft 35. After the rotor assembly has been removed, it is then relatively simple to remove and replace the screening cylinder. It is also then similarly easy to remove and replace the drive cartridge 75, after releasing the bolts 90, which are accessible after the rotor assembly is removed, and also releasing the bolts 94 to which access is provided through the open back end of the housing 10.

Figure 5:
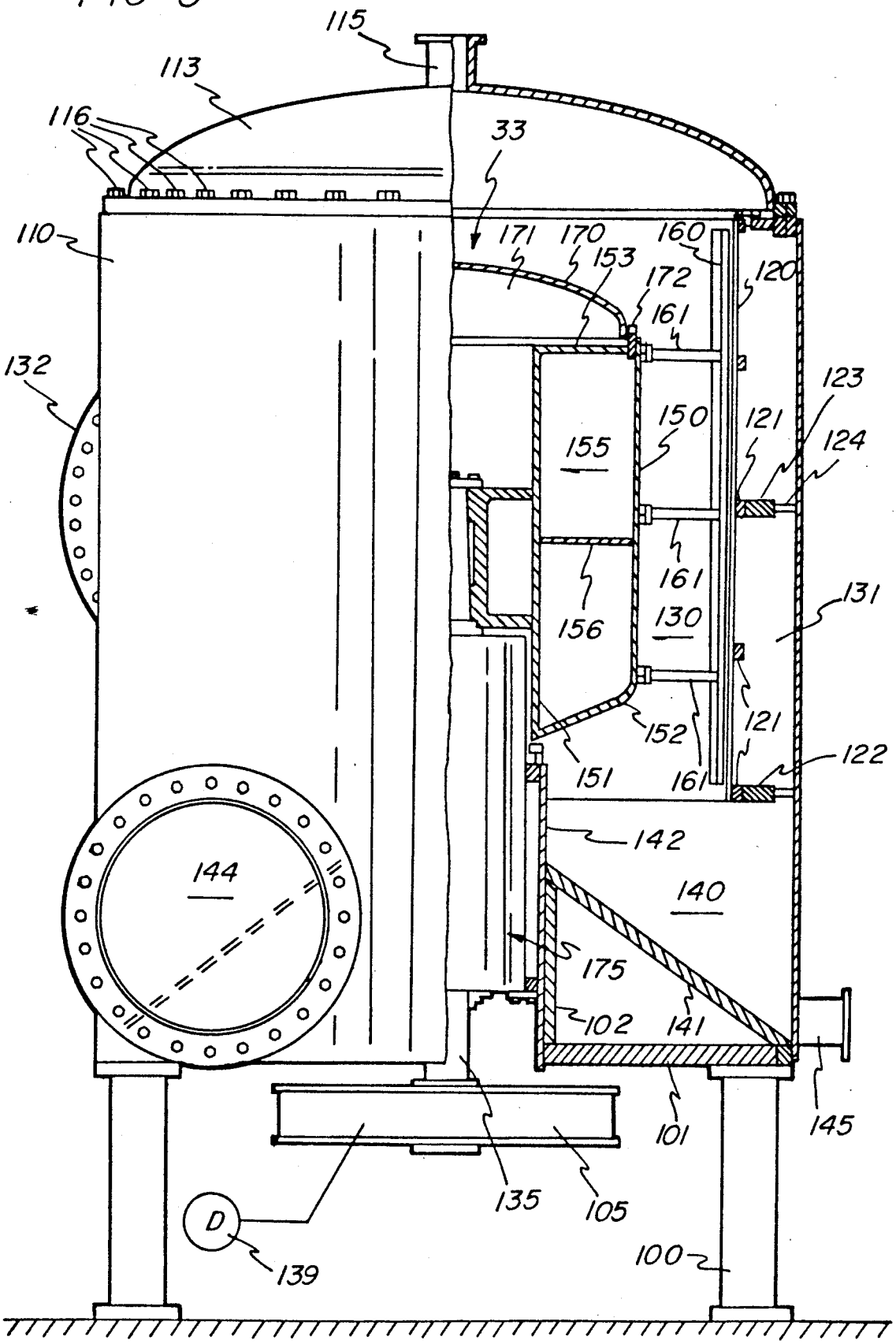
FIG. 5 is an elevational view of another embodiment of the invention.

The advantages of the invention as discussed above are especially important in conjunction with a horizontally mounted screen, but the invention also provides similar advantages in the more conventional style of a vertically mounted screen. Referring to FIG. 5, wherein the reference characters duplicate those in FIGS. 1–4 with 100 added, the housing 110 is oriented vertically and is supported at its lower end by pedestal members 100, and it will be noted that while the corresponding end of the housing 110 is open, the housing 110 requires an annular bottom plate 101 and a tubular bracing member 102 extending between the inner periphery of the bottom 101 and the small end of the conical wall 141. In addition, the reject outlet 144 is located adjacent the bottom of the inlet chamber 140 to take maximum advantage of the gravitational forces in removing heavy reject material.

The internal structure of the screening apparatus shown in FIG. 5 may be otherwise essentially identical with the corresponding structure already described in connection with FIGS. 1–4, but the drive for the rotor assembly 133 will preferably comprise a sheave 105 on the lower end of the drive shaft 135.

As already noted, with the rotor assembly 133 of the same structure described for the rotor assembly 33, when the housing 110 is filled with feed stock, the buoyancy provided by the sealed air space in the rotor assembly will counterbalance the weight of the rotor assembly and thereby minimize the gravitational load on the bearings in the drive cartridge 175, thereby making it unnecessary to provide the heavy duty bearings and bearing housing which would otherwise normally be needed for a vertically mounted rotor assembly. In this respect, therefore, the advantages of the invention are fully applicable to a vertically mounted screening apparatus as shown in FIG. 5.

While the forms of apparatus herein described constitute preferred embodiments of the invention, it is to be understood that the invention is not limited to these precise forms of apparatus and that changes may be made therein without departing from the scope of the invention which is defined in the appended claims.

What is claimed is:

1. Apparatus for screening paper making stock comprising:

(a) a tubular housing, (b) a perforate screening cylinder supported within and separating the interior of said housing into a screening chamber within said cylinder and an annular accepts chamber between said cylinder and said housing, (c) means defining an inlet chamber within one end of said housing which is connected with the adjacent end of said screening chamber and has an inlet port leading thereto from outside said housing, (d) a door removably secured to the other end of said housing and closing the other end of said screening chamber, (e) means forming an outlet port from said accepts chamber, (f) means forming a reject outlet port from said screening chamber, (g) a rotor assembly received within said screening cylinder, (h) drive means for said rotor assembly outside said housing and including a drive shaft extending into said housing through said inlet chamber, (i) means securing said rotor assembly on said drive shaft, (j) bearing means fixed with relation to said housing and supporting said drive shaft and said rotor assembly for rotation within said cylinder, (k) said rotor assembly including tubular outer and inner walls and end walls cooperating to enclose a sealed space, (l) vane means mounted on the outside of said outer wall for generating alternating positive and negative pressure waves adjacent the ends of the perforations in said screening cylinder in response to rotation of said rotor assembly, and (m) said sealed space being of predetermined volume providing said rotor assembly with buoyancy substantially counterbalancing the weight of said rotor assembly when said housing is filled with stock.

2. Screening apparatus as defined in claim 1 further comprising means supporting said housing and said drive means with said drive shaft extending horizontally.

3. Screening apparatus as defined in claim 1 further comprising means supporting said housing and said drive means with said drive shaft extending vertically upwardly.

4. Screening apparatus as defined in claim 1 wherein said rotor assembly comprises, an outer tubular wall, an inner tubular wall of substantially smaller diameter proportioned to receive said drive shaft therein and received within and in concentric relation with said outer wall to define therewith an annular compartment forming a part of said sealed space, annular end walls secured between said tubular walls to seal said compartment, hub means secured within said inner tubular wall, means for securing said hub means on said drive shaft, and a cover enclosing and secured to the end of said outer tubular wall remote from said drive means and cooperating with said outer tubular wall to enclose a second compartment within said end of said rotor assembly which forms another part of said sealed space.

5. Screening apparatus as defined in claim 4 wherein said hub means is located at an intermediate position in said inner tubular wall to leave open the end portion of said wall away from said drive shaft, said cover is removably secured to said outer tubular wall, and said means for securing said hub means on said drive shaft are releasable and are accessible through said open end portion of said inner tubular wall when said cover is removed from said outer wall.

6. Apparatus for screening paper making stock comprising:

(a) a tubular housing, (b) base means supporting said housing in a horizontal position, (c) a perforate screening cylinder supported within and separating the interior of said housing into a screening chamber within said cylinder and an annular accepts chamber between said cylinder and said housing, (d) means defining an inlet chamber within one end of said housing which is connected with the adjacent end of said screening chamber and has an inlet port leading thereto from outside said housing, (e) a cover releasably secured to the other end of said housing and closing the other end of said screening chamber, (f) means forming an outlet port from said accepts chamber, (g) means forming a reject outlet port from said screening chamber, (h) a rotor assembly including a rotor body received within said screening cylinder, (i) drive means for said rotor assembly outside said housing and including a drive shaft extending horizontally into said housing through said inlet chamber, (j) means securing said rotor assembly on said drive shaft, (k) bearing means mounted within said inlet chamber end of said housing and supporting said drive shaft and said rotor assembly for rotation within said cylinder, (l) said rotor assembly comprising an outer tubular wall and an inner tubular wall of substantially smaller diameter proportioned to receive said drive shaft therein and received within and in concentric relation with said outer wall to define therewith an annular compartment, (m) annular end walls secured between said tubular walls to seal said annular compartment, (n) hub means secured within said inner tubular wall, (o) means for securing said hub means on said drive shaft, (p) a cover enclosing and secured to the end of said outer tubular wall remote from said inlet chamber and cooperating with said outer tubular wall to enclose a second compartment within said end of said rotor assembly, (q) vane means mounted on the outside of said outer tubular wall for generating alternating positive and negative pressure waves adjacent the ends of the perforations in said screening cylinder in response to rotation of said rotor assembly, and (r) said compartments being of predetermined total volume providing said rotor assembly with buoyancy substantially counterbalancing the weight of said rotor assembly when said housing is filled with stock.

7. Screening apparatus as defined in claim 6 wherein said hub means is located at an intermediate position in said inner tubular wall to leave open the end portion of said wall away from said drive shaft, said cover is removably secured to said outer tubular wall, and said means for securing said hub means on said drive shaft are releasable and are accessible through said open end portion of said inner tubular wall when said cover is removed from said outer wall.

* * * * *